US007433640B2

(12) United States Patent
Yagi et al.

(10) Patent No.: US 7,433,640 B2
(45) Date of Patent: Oct. 7, 2008

(54) FIXING APPARATUS AND IMAGE FORMING APPARATUS INCLUDING HEATING MEMBER

(75) Inventors: Masahiro Yagi, Ibaraki (JP); Toshio Ogiso, Ibaraki (JP); Shunichi Oohara, Ibaraki (JP); Shigeru Obata, Ibaraki (JP); Toru Hanashima, Ibaraki (JP); Osamu Saito, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 228 days.

(21) Appl. No.: 11/374,008

(22) Filed: Mar. 14, 2006

(65) Prior Publication Data

US 2007/0071514 A1 Mar. 29, 2007

(30) Foreign Application Priority Data

Mar. 15, 2005 (JP) ..... P2005-072599
Mar. 15, 2005 (JP) ..... P2005-072607

(51) Int. Cl.
*G03G 15/20* (2006.01)

(52) U.S. Cl. ..... 399/329

(58) Field of Classification Search ..... 399/329, 399/328; 219/216
See application file for complete search history.

(56) References Cited

U.S. PATENT DOCUMENTS 5,621,512 A * 4/1997 Uehara et al. ..... 399/328
5,666,624 A 9/1997 Kanesawa et al.
2004/0131401 A1* 7/2004 Nakatogawa et al. ..... 399/328
2004/0184850 A1 9/2004 Yoneda et al.
2005/0047838 A1 3/2005 Uehara et al.
2005/0220467 A1* 10/2005 Takahashi et al. ..... 399/329
2006/0056887 A1* 3/2006 Maeyama et al. ..... 399/328
2006/0083562 A1* 4/2006 Matsumoto et al. ..... 399/329
2007/0065193 A1* 3/2007 Jang et al. ..... 399/329
2007/0065194 A1* 3/2007 Kim et al. ..... 399/329

FOREIGN PATENT DOCUMENTS

JP 3298354 10/1996
JP 2004-29607 1/2004

OTHER PUBLICATIONS

Office Action dated Jun. 23, 2008 in U.S. Appl. No. 11/508,273.

* cited by examiner

*Primary Examiner*—Susan S. Lee
(74) *Attorney, Agent, or Firm*—McGinn IP Law Group, PLLC

(57) ABSTRACT

In a fixing apparatus including heating member having an elastic layer and a heat source and pressing member having an endless shape member and a pressing member for transporting a record medium in a cut sheet shape while being adhered with an unfixed toner image to pass a nip portion formed by the endless shape member and the heating member and fixing the unfixed toner image on the record medium, the fixing apparatus is constructed by a constitution in which a space between the toner image on the record medium and a surface of the heating member is widened immediately after the record medium is projected from an outlet of the nip portion.

12 Claims, 8 Drawing Sheets

| PAD WIDTH | MEAN NIP WIDTH | CLEARANCE AT HEAT PROJECTED AMOUNT OF 3mm | EXFOLIATION |
|---|---|---|---|
| (mm) | (mm) | (mm) | |
| 4 | 5.0 | 0.648 | REMARKABLY IMPROVED |
| 6 | 5.9 | 0.421 | MORE LESS IMPROVED |
| 8 | 6.6 | 0.408 | NOT IMPROVED |

| MOVING AMOUNT FROM MAXIMUM NIP OUTLET POINT | EXFOLIATING FORCE (SHEET PROJECTED AMOUNT 3.5mm) | EXFOLIATING CHARACTERISTIC |
|---|---|---|
| mm | kgf/mm | |
| -1.2 | 0.065 | IMPROVED |
| -0.3 | 0.045 | ( ) |
| 0.7 | 0.038 | NOT IMPROVED |

FIG. 14

| COMBINATION | EXFOLIATING FORCE kgf/mm | EXFOLIATING CHARACTERISTIC |
|---|---|---|
| A | 0.07 | FURTHER MORE IMPROVED |
| B | 0.05 | MORE IMPROVED |
| C | 0.04 | IMPROVED |
| D | 0.03 | NOT IMPROVED |
| E | 0.02 | NOT IMPROVED |

FIXING APPARATUS AND IMAGE FORMING APPARATUS INCLUDING HEATING MEMBER

CROSS-REFERENCE TO RELATED APPLICATIONS

This application is based on and claims the benefit of priority from the prior Japanese Patent Applications No. 2005-72599, filed on Mar. 15, 2005, and No. 2005-72607, filed on Mar. 15, 2005; the entire contents of which are incorporated herein by reference.

TECHNICAL FIELD

The present invention relates to a fixing apparatus and an image forming apparatus using the same.

BACKGROUND

In a related art, there is an apparatus for fixing a toner image on a record medium in which a heating roller is heated by a halogen heater arranged at inside of the roller, a pressing roller is pressed to the heating roller by a coil spring or the like to form a nip portion between the rollers, and the record medium adhered with a toner is made to pass through the nip portion to be pressed and heated to fix. However, in order to achieve high speed formation, small-sized formation, high reliability, energy saving formation, and low cost formation by the type of bringing the rollers into contact with each other, the following problem is posed.

First, in accordance with high speed formation, it is necessary to prolong a distance of heating the toner on the record medium. A heating time period the same as that before increasing a speed is ensured. In order to prolong a length of the nip portion, it is necessary to make a surface of the roller elastically deformable and increase a load value, or increase a diameter of the roller. However, an increase in the diameter of the roller contradicts to small-sized formation. Next, there is conceivable a method of reducing an elastic coefficient of the surface of the roller and increasing the load value. In order to reduce the elastic coefficient of the surface of the roller, it is necessary to increase a thickness of a surface layer of the roller or reduce Young's modulus of the member. However, when the thickness of the surface layer of the roller is increased, a heat capacity of a total of the heating roller is increased, a heating time period necessary for elevating a surface temperature of the heating roller to a certain constant temperature is prolonged, as a result, a printing time period is prolonged. Although there is a method of maintaining the temperature of the heating roller by supplying heat at all times at standby, the method contradicts to energy saving formation. On the other hand, when the load value for bringing the rollers into press contact with each other is increased, it is conceivable that a pressure difference of the nip portion is brought about between a center portion and an end portion in an axial direction of the roller and a characteristic for fixing the toner becomes nonuniform. Further, there is a concern that a nonuniformity in a pressure distribution produces wrinkle of paper, as a result, reliability of the apparatus is deteriorated. When a bending amount is reduced, a rigidity of the roller is increased, or the roller is formed of a crown shape. However, when the rigidity of the roller is increased, the heat capacity of the roller is increased, and the heating time period is prolonged, which contradicts to energy saving formation. According to the roller having the crown shape, a number of roller forming steps is increased and low cost formation is difficult. Further, the pressure distribution of the axial direction depends on an accuracy of working the roller, as a result, there is a possibility of deteriorating reliability.

In order to resolve the problems, various proposals have been made (for example, Japanese Patent No. 3298354). According to the related art, there is a belt nip type of a fixing apparatus in which a pressing member for elastically deforming locally an outlet portion of a heating roller is brought into press contact with the rotatable heating roller a surface of which is elastically deformed to form a nip portion and a toner image on a record medium fed to therebetween is pressed and heated to fix. According to the type, by providing the pressing member to form a contact face from an inner side of an endless belt, a nip width can be formed to be long, sufficient heat can be applied to the toner and high speed formation of a printing speed can easily be dealt with. Further, the nip width can be formed to be long without enlarging a total of the apparatus to be able to deal with small-sized formation of a total of the apparatus. Further, the long nip width can be formed by a low pressure, thin-walled formation of the heating roller is facilitated, a heating time period up to a temperature proper for fixing can be shortened, printing can be started quickly and therefore, an energy saving effect can be promoted. Further, by pressing an elastic layer of the heating roller by a hard member, the elastic layer is locally warped at the nip outlet portion, a self stripping (self exfoliating) function is promoted and reliability thereof is high.

However, according to the belt nip type fixing apparatus, there poses a problem that an image shift is liable to be brought about owing to a speed difference by locally deforming the outlet portion. Further, by pressing an elastic layer of the heating roller by the hard member, the elastic layer is locally warped to produce a nip shape having a small curvature and therefore, a load (curl amount) applied to a sheet is increased.

SUMMARY

The present invention has been made in view of the above circumstances and provides a fixing apparatus at least including heating member, a pressing member and an endless shape member and a fixing apparatus or an image forming apparatus simplifying a constitution of the apparatus, promoting a performance of exfoliating a record member from the heating member without applying a large load on the record medium and promoting also an image quality formed on the record medium.

According to an aspect of the invention, there is provided a fixing apparatus for transporting a record medium while being adhered with an unfixed toner image to pass a nip portion formed by an endless shape member included in a pressing member and a heating member including an elastic layer and a heat source, and for fixing an unfixed toner image on a record medium. The pressing member is a pressing member in which a width of the pressing member in a direction of transporting the record medium becomes a width the same as a nip width formed when the heating member is pressed by using an infinite flat plate to be brought into contact therewith or smaller than the width.

In order to resolve the above-described problem, the problem is achieved to be also resolved by a fixing apparatus for transporting a record medium while being adhered with an unfixed toner image to pass a nip portion formed by an endless shape member included in a pressing member and a heating member including an elastic layer and a heat source, and for fixing an unfixed toner image on a record medium. In the fixing apparatus, an exfoliating force at a point apart from a point of separating a surface of the record medium and a surface of the heating member at the nip portion by 3.5 mm along the surface of the record medium is set to be equal to or larger than 0.04 kgf/mm.

BRIEF DESCRIPTION OF THE DRAWINGS

These and other objects and advantages of this invention will become more fully apparent from the following detailed description taken with the accompanying drawings in which:

FIG. 14 shows a result of an exfoliating experiment carried out by the fixing apparatus of FIG. 1.

DESCRIPTION OF THE EMBODIMENTS

Embodiments of the invention will be explained in reference to the drawings, the invention is not naturally limited to specific constitutions thereof.

Embodiment 1

An embodiment of the invention will be explained in reference to FIGS. 1 through 5.

Figure 1:
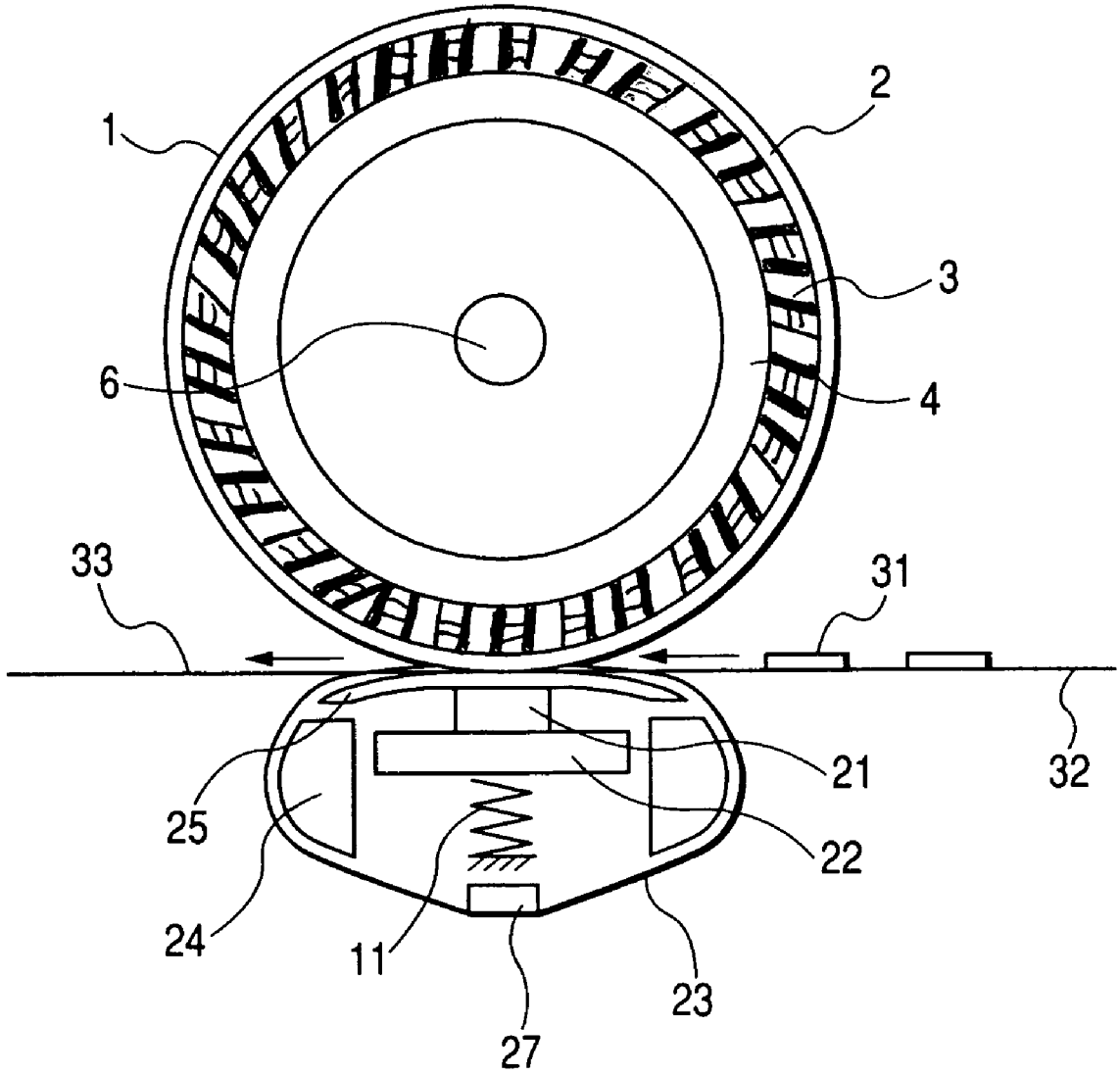
FIG. 1 is a schematic view of a fixing apparatus according to an embodiment of the invention.

FIG. 1 is a schematic view of a fixing apparatus according to the embodiment. In FIG. 1, numeral 1 designates a heating roller and a heating roller 1 includes a surface coating layer 2, an elastic layer 3, a mandrel 4, and a heat source 6. Numeral 32 designates a record medium, and numeral 31 designates an unfixed toner adhered to a surface of the record medium 32. The record medium 32 is carried in an arrow mark direction of FIG. 1. A pressing member is provided by interposing the record medium 32 between the heating roller 1 and the pressing member. The pressing member includes a pressing member 21, a supporting member 22 for supporting the pressing member 21, a pressing spring 11 for pressing the pressing member 21 and the supporting member 22 to a side of the record medium 32, a driven endless shape member 23, a low friction member 25 for reducing friction between the endless shape member 23 and the pressing member 21, and a guide 24 for rectifying a path of transporting the endless shape member 23. Numeral 27 designates a lubricant supplying member for supplying a lubricant for further reducing the friction between the endless shape member 23 and the pressing member 21. Generally, the lubricant including silicone oil or fluorine oil or the like is used. Numeral 33 designates a fixed image on the record medium 32 after passing through a nip portion between the heating roller 1 and the endless shape member 23. As the surface coating layer 2 of the heating roller 1, a PFA layer or the like is used such that the unfixed toner 31 is difficult to be adhered thereto. Further, as the elastic layer 3, silicone rubber is used. The endless shape member 23 is formed by PFA and polyimide. As the pressing member 21, a pressing pad a surface in a pressing direction of which is flat is used including a rubber layer of silicone or fluorine rubber. Here, as the record medium 32, a sheet of cut paper or the like is pointed out.

Figure 2:
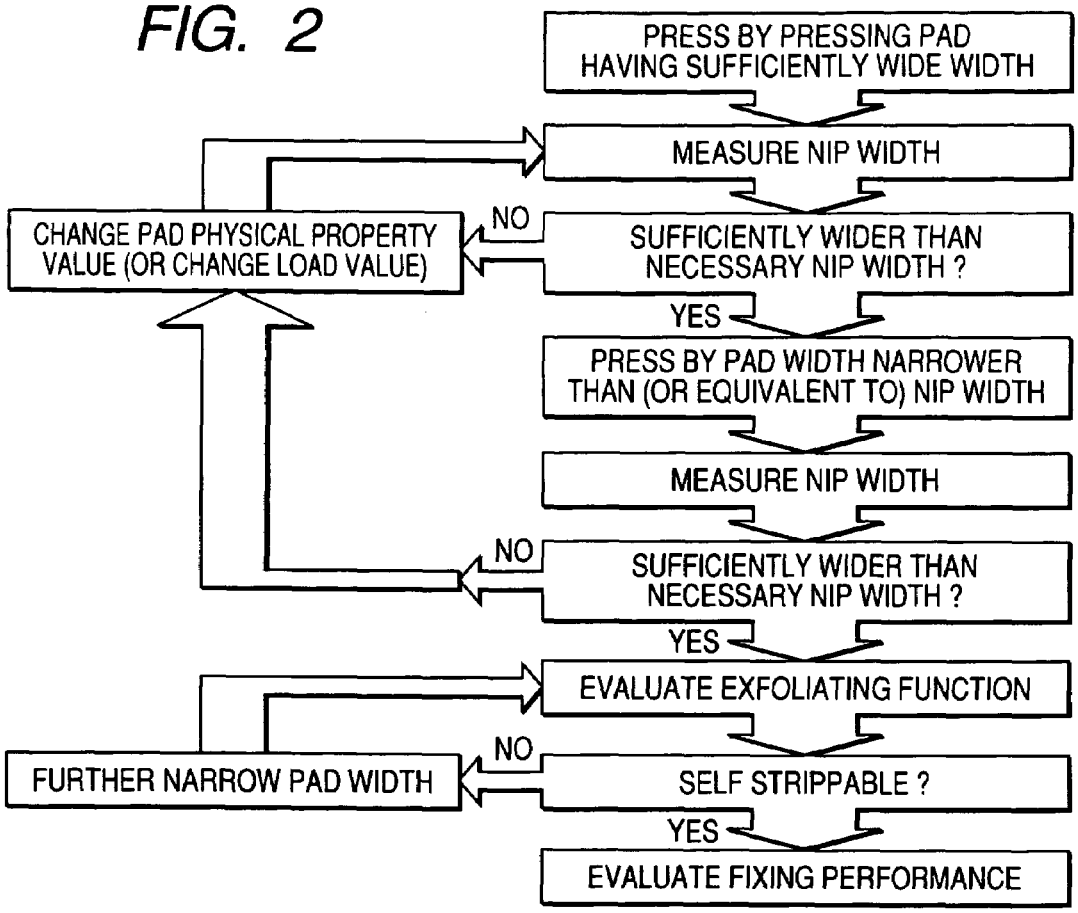
FIG. 2 is a flowchart showing a procedure of a pad optimum constitution.

FIG. 2 is a flowchart for providing an optimum pad constitution. First, the nip portion is formed by a sufficiently wide pad. At this occasion, what requires caution is that in the case of the pressing member 21 having an elastic layer, a width of the pad after having been pressed differs by a load value and a dimension of the member, Young's modulus, Poisson's ratio. That is, it is necessary to press by a pad having a sufficient width up to an area at which deformation of the pad is not effected. Next, the nip width is measured, when the nip width is equal to or smaller than a necessary width, a material of the pad, a shape of the pad, or the load value or the like is changed and the nip width is measured again. Generally, a gross value of the nip width is changed by heating a solid print image while squeezing the solid print image at the nip portion intended to be measured for several seconds, and the nip width can be confirmed by measuring a high gross region. Or, there is also a measuring method of nipping a thin type pressure sensor sheet and measuring the nip width by a change in a voltage. When the measured nip width is sufficiently wider than the necessary nip width, next, the pad width is gradually narrowed, and the nip width is measured again. When an arbitrary nip width cannot be provided by narrowing the pad width, a physical property value or the like of the pad is changed by the pad having the sufficiently wide width again to repeat the series of operation until providing the arbitrary nip width. When the necessary nip width is provided, an exfoliating function is evaluated. Generally, the exfoliating function can be confirmed by passing the sheet to the nip portion and measuring a relative distance between the sheet and the surface of the heating roller at an outlet portion of the nip. Or, there is also a method of fixing an unfixed image and evaluating whether the unfixed image is made to wrap on the roll. The exfoliating characteristic is evaluated by the above-described method and the pad width is adjusted until providing the exfoliating function by which the sheet can be stripped off by itself. Finally, after providing the exfoliating function, a fixing function is evaluated. At this occasion, it is necessary to increase a mean pressure (0.010 kgf/mm$^2$ or higher) sufficiently such that air or steam is not expanded from the sheet or the toner and the unfixed toner is not disturbed by evaporating air bubbles. Further, it is necessary to construct a configuration by which a discontinuous pressure distribution which is liable to bring about a failure in fixing, or a local valley of pressure is not brought about and set a pressure distribution as smooth as possible.

Figure 3:
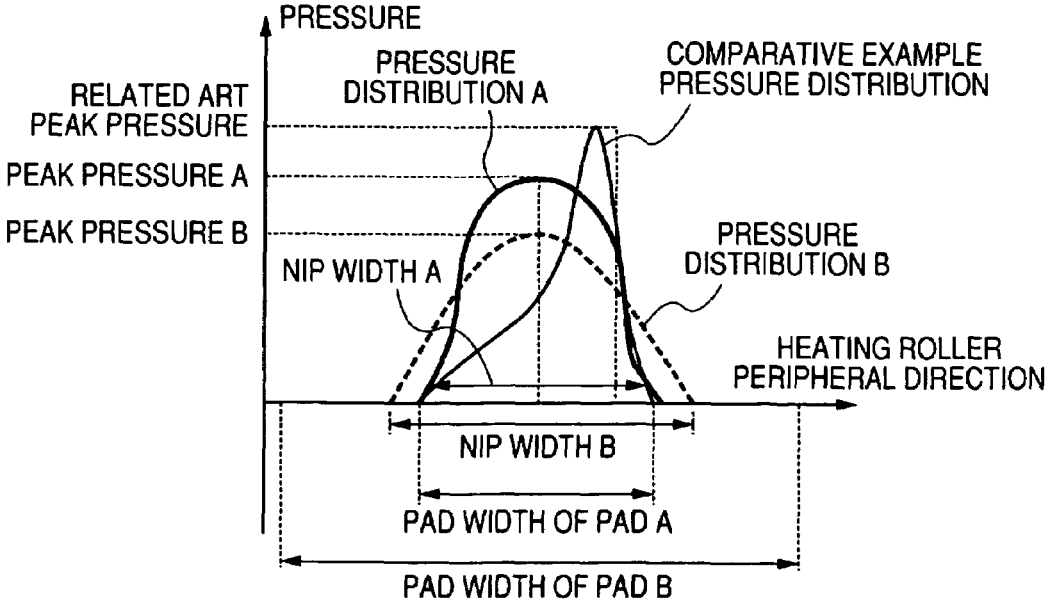
FIG. 3 is a graph showing a pressure distribution in a peripheral direction of a heating roller at a nip portion according to the embodiment.

FIG. 3 shows an example of a pressure distribution of the nip portion provided when the heating roller 1 is pressed by a pad a pressing face of which is flat and which includes an elastic layer in a peripheral direction of the heating roller 1 and a pressure distribution of a comparative example. In a graph of FIG. 3, the ordinate designates a pressure and the abscissa designates a peripheral direction of the heating roller. The record medium 32 advances to the nip portion between the heating roller and the pressing member from the left side (side of writing the ordinate). An explanation will be given as follows by a left side of the distribution line as an inlet to the nip portion and a right side thereof as an outlet from the nip region. The nip width is a nip width in a direction of transporting the record medium 32.

A slender bold line indicates the comparative example and is an example of a pressure distribution provided by a constitution in which the outlet portion is pressed by a hard member to be locally deformed and a region from the inlet to a center portion is pressed by a pad having an elastic layer. The slender bold line is simply indicated for comparison. A broken line indicates a pressure distribution B provided when pressed by a pad B formed with a pad width sufficiently wider than the nip width. Assume that a similar pressure distribution is provided by assumedly using an infinite flat plate. A bold line indicates an example of a pressure distribution A provided by a pad A having a pad width narrower than the nip width provided when pressed by the pad B. Assume that pad A includes an elastic layer having a uniform distribution. For example, the pressure distribution by the pad A is a pressure distribution after adjusting the pad constitution in accordance with the flowchart of FIG. 2 by a constitution as in FIG. 1 or FIG. 4. As shown by FIG. 3, when a load value of the pad A is not changed from that of the pad B, the nip width is narrowed by narrowing the pad width, and a peak pressure A of the pressure distribution A becomes larger than a peak pressure B of the pressure distribution B. Further, a slope of a pressure at the outlet portion of the nip of the pressure distribution A becomes larger than that of the pressure distribution B. The slope of the pressure of the outlet portion of the nip of the pressure distribution A is substantially the same as a slope of a pressure at an outlet portion of the nip of the comparative example. Such a pressure distribution is operated to increase an amount of deforming the outlet portion of the nip of the elastic layer 3 of the heating roller 1 and increase an angle of projecting the record medium 32 in a direction of separating from the surface of the heating roller 1. That is, it seems that there is achieved an effect of promoting a characteristic of the record medium 32 of exfoliating from the heating roller 1 by increasing a space between the toner image after having been fixing adhered to the surface of the record medium 32 and the surface of the heating roller 1 immediately after projecting a front end of the record medium 32 from the outlet portion of the nip region. That is, this is a curvature exfoliating operation utilizing a rigidity of the record medium 32.

Figures 4, 5:
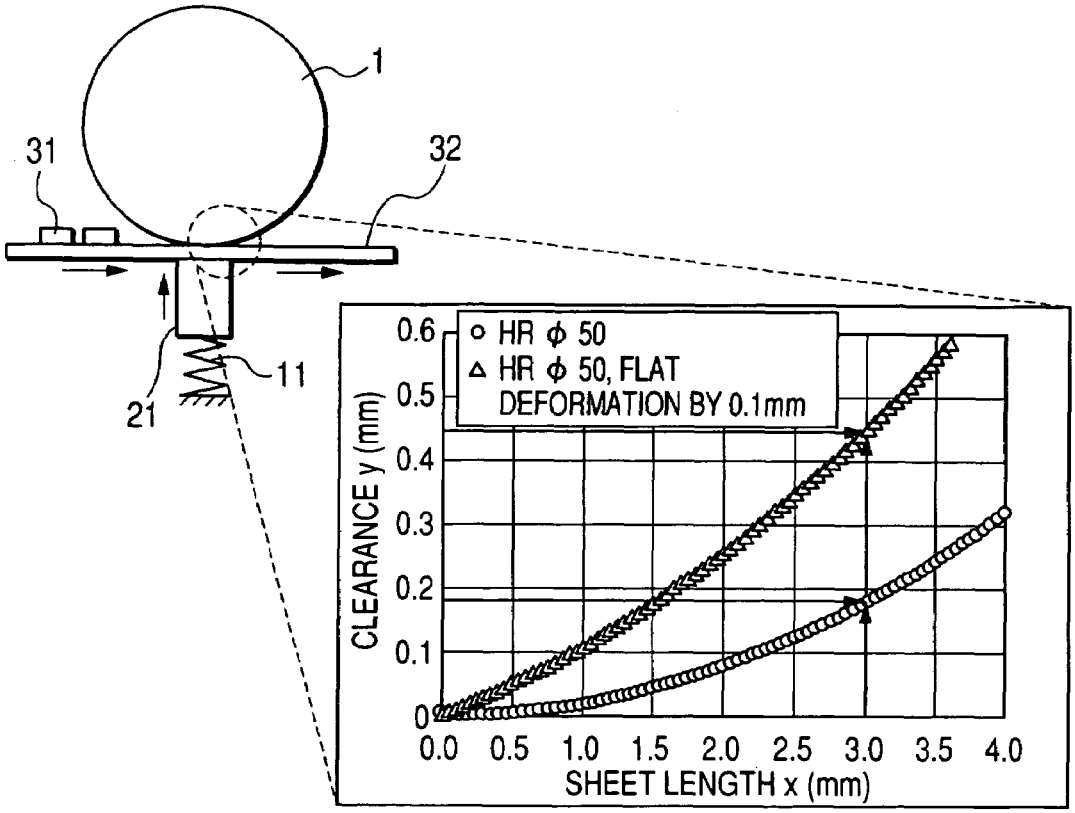
FIG. 4 shows an example of a calculating value showing a relationship between deformation of a nip outlet portion and an exfoliating function.
FIG. 5 shows a result of an exfoliating experiment which is carried out by the fixing apparatus of FIG. 1.

FIG. 4 shows a result of calculating a representative example of the effect by a geometrical calculation. There is calculated by the geometrical calculation a shape of deforming the outlet portion from the nip region in a state in which the heating roller 1 and the pressing member 21 are brought into press contact with each other by the pressing spring 11 and the record medium 32 is passed in the arrow mark direction through the heating roller 1 and the pressing member 21. ○ mark designates a shape of deforming the outlet portion when the heating roller 1 is provided with a diameter of 50 mm and the elastic layer is not deformed. Δ mark shows a shape of deforming the outlet portion when the heating roller 1 is provided with a diameter of 50 mm and the surface of the elastic layer is deformed to be flat by 0.1 mm. By comparing the two deformed shapes, when not deformed, a space (clearance) between the image face of the record medium 32 and the surface of the heating roller 1 at the outlet portion is narrow, when the amount of projecting the front end of the record medium 32 is 3 mm, there is only the clearance of about 0.20 mm. On the other hand, when deformed, the space (clearance) between the image face of the record medium 32 and the surface of the heating roller 1 at the outlet portion is wide, and when the amount of projecting the front end of the record medium 32 is 3 mm, a clearance of about 0.45 mm is provided. For example, curvature exfoliating force can be calculated from a load value necessary for bringing the front end of the record medium 32 into contact with the surface of the heating roller 1 from Young's modulus and a moment of inertia of ordinary sheet referred to as ordinary paper by using a simple beam model.

When the comparative example is used, the exfoliating function can easily be provided by taking a look at the slope of the pressure distribution at the outlet portion of the nip region shown by FIG. 3. However, by elastically deforming the heating roller 1 at the outlet portion of the nip region locally by using the hard member, the speed difference is brought about at inside of the nip region, as a result, the image shift is brought about. Although according to the comparative example, such a problem is resolved by setting the load at an outlet portion, it is difficult to reduce the load applied to the record medium 32 by locally deforming the elastic layer of the heating roller 1 (paper damage). According thereto, the curvature of the nip shape is reduced by using the hard member and the load on the record medium by the small curvature is increased. On the other hand, according to the embodiment, the function of exfoliating the record medium 32 from the heating roller 1 can be promoted without producing the portion of deforming the nip by the small curvature and therefore, damage on the record medium 32 can be restrained to be small. Further, there can be provided a fixing apparatus suitable for designing a robust nip shape having a low sensitivity against a load value in comparison with a structure in which by pressing by a pad providing a nip width narrower than an inherently provided nip width, the nip shape in the axial direction follows the shape of the pressing member and the nip width and the pressure are varied by a variation of the load value as in the comparative example. As a more important point, the embodiment can be constituted by the pressing member 21 having a constitution as shown by FIG. 1 which is simpler than that of the pressing member of the comparative example. A number of steps of forming parts of the pressing member 21 is reduced. A cost of forming parts of the pressing member 21 can be reduced. By using the pressing member 21 having the simple constitution, there can be avoided a particular problem caused by the constitution for producing an excessively low pressure locally, or producing a discontinuous pressure distribution or a valley in the pressure, which has been problematic in the background art (air or steam is expanded from sheet or toner and the unfixed toner is disturbed by evaporating bubbles).

FIG. 5 shows a result of transporting out an exfoliating experiment by the fixing apparatus shown in FIG. 1. The exfoliating experiment is carried out by changing only the pad width by setting the same condition for all of the experiments, mentioned later. A cur sheet is used as the record medium. According to the experiment, a full color image is adhered onto a general sheet having a basis weight of 5.5 g/cm$^2$ and the experiment is carried out by the fixing apparatus shown in FIG. 1. As a result, when the pad width is 8 mm, the unfixed toner image is made to wrap on the heating roller 1 and the sheet is not exfoliated. By using a laser depth meter, the projected angle of the sheet and the space (clearance) between the sheet image face and the surface of the heating roller 1 at the nip outlet portion are measured. At a point of the amount of projecting the sheet of 3 mm, the clearance amount is 0.408 mm. Although by narrowing the pad width to 6 mm, the exfoliating function is more less increased, a significant difference is not observed such that the clearance amount is 0.421 mm. However, when the pad width is narrowed to 4 mm, the exfoliating function is remarkably improved, the measured clearance amount becomes 0.648 mm and self stripping performance is confirmed. The clearance amount effects an influence on the exfoliating function. Further, it is confirmed that sufficient fixing energy is provided by the pad width of 4 mm.

In the above-described test, for example, there is used the pressing pad having a load of the pressing member 21 of 35 kgf by the pressing spring 11, a rubber hardness of 50 Hs, a thickness of 4 mm, and a width of 230 mm in an axial direction. At this occasion, in the direction of transporting the record medium, in the case of the pad width of 8 mm, the maximum pressure becomes 0.040 kgf/mm$^2$, the mean pressure becomes 0.023 kgf/mm$^2$, in the case of the pad width of 6 mm, the maximum pressure becomes 0.048 kgf/mm$^2$, the mean pressure becomes 0.026 kgf/mm$^2$ and in the case of the pad width of 4 mm, the maximum pressure becomes 0.052 kgf/mm$^2$, and the mean pressure becomes 0.030 kgf/mm$^2$.

Further, the inventors of the invention confirm that a similar effect is achieved by the load of 35 though 40 kgf and the rubber hardness of 30 Hs.

Embodiment 2

Figure 6:
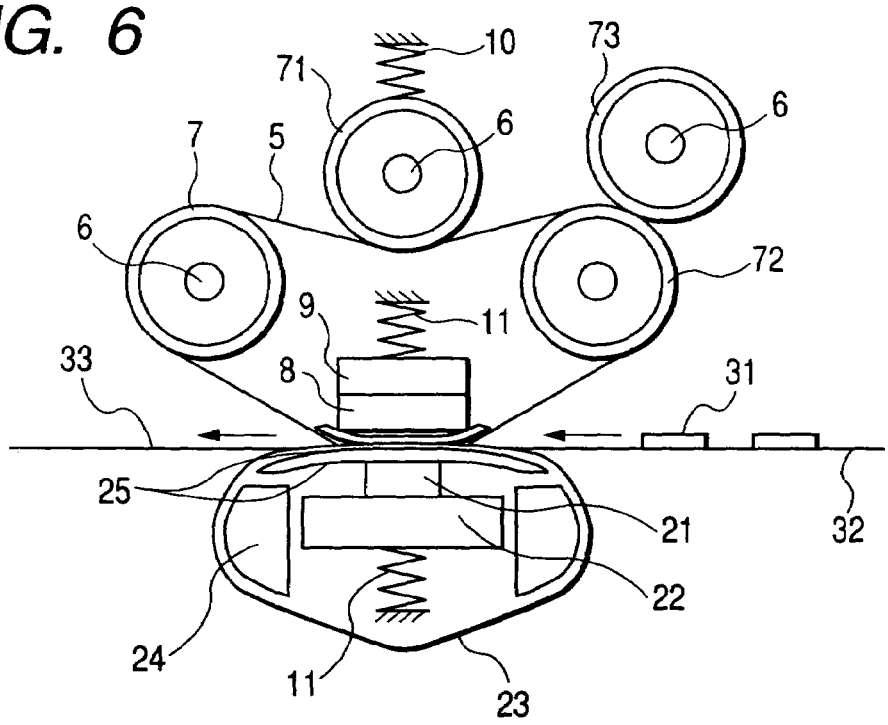
FIG. 6 is a schematic view of a fixing apparatus according to another embodiment.

FIG. 6 shows another embodiment of the invention. Portions the same as those of FIG. 1 will be explained by the same numerals. A member designated by numeral 5 provided on a side of the image face of the record medium 32 adhered with the unfixed toner 31 is an endless shape heating member. Numeral 8 designates a pressing member having an elastic layer. Numeral 9 designates a pressing support member for supporting the pressing member 8. Numeral 6 designates a heat source. Numeral 7 designates a heating roller for hanging, or simultaneously heating the endless shape heating member 5. There is also a method of heating the endless shape heating member 5 from an outer side by bringing a heating roller 71 or 73 into contact therewith when a heat amount is deficient. Numeral 72 designates a driven roller rotated without having a heat source at inside thereof. Although a drive source for driving the endless shape heating member is disposed at the heating roller 7, the drive source may be provided at the driven roller 72. Since the constitution uses the endless shape heating member, the constitution is provided with a characteristic that in comparison with the constitution of using the heating roller 1 as in FIG. 1, the nip width or the deformed shape of the nip outlet portion can be adjusted without influencing on the size of the total of the apparatus considerably. In the case of the constitution, it is necessary to set the width of the pressing member 21 equivalent to or smaller than the width of the pressing member 8.

Embodiment 3

Another embodiment of the invention will be explained in reference to FIGS. 7 through 12 as follows.

Figure 7:
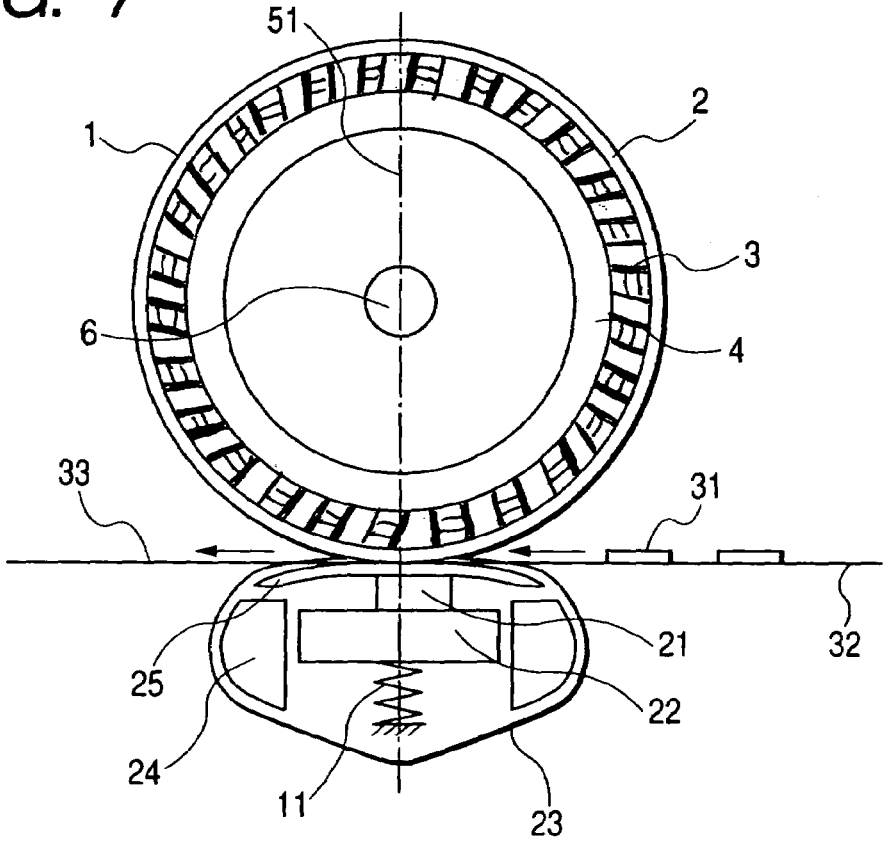
FIG. 7 is a schematic view of a fixing apparatus according to another embodiment.

Constitutions in FIG. 7 the same as those of FIG. 1 are attached with the same numerals and therefore, an explanation thereof will be omitted. Numeral 51 designates a center line passing a rotational axis of the heating roller. The pressing member 21 is provided at a position proximate to an inlet side of the record medium 32. Specifically, a center of a width in a direction of transporting the record medium 32 is provided at a position proximate to an inlet side of the center line 51. The pressing pad is used as the pressing member 21 similar to the case of FIG. 1. The lubricant supply member 27 may be provided similar to FIG. 1.

Figure 8:
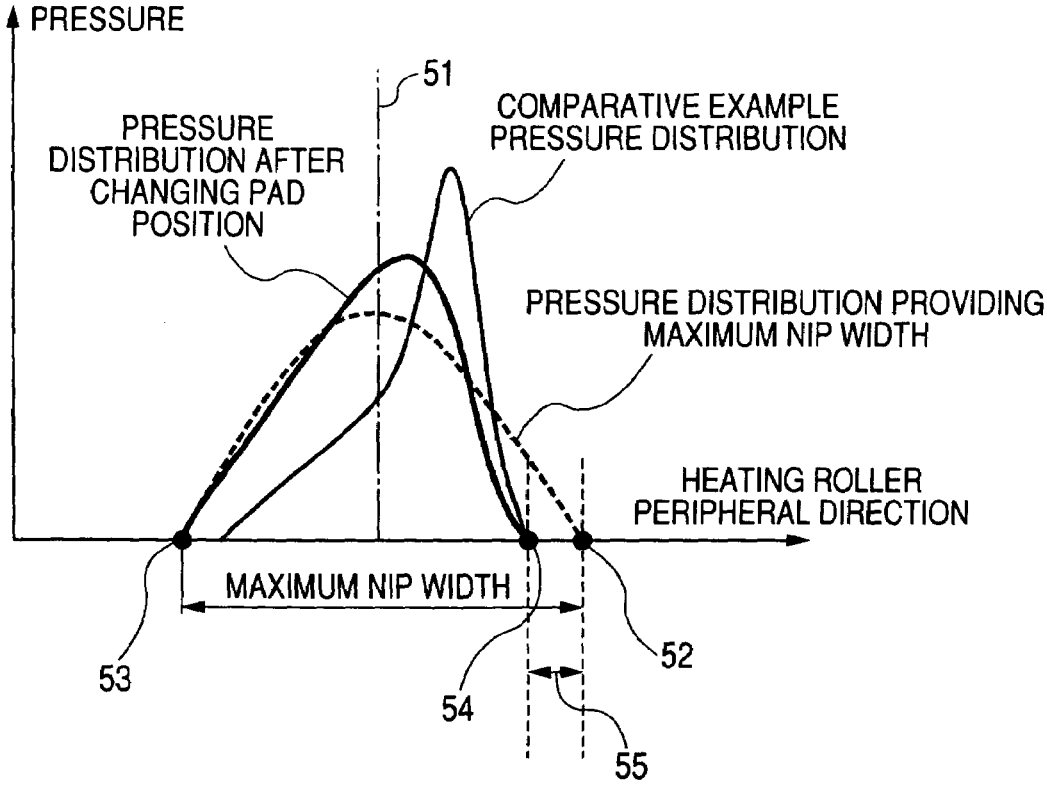
FIG. 8 is a graph showing a pressure distribution in a peripheral direction of a heating roller at a nip portion according to another embodiment.

Successively, a distribution of a pressure will be explained in reference to FIG. 8. Similar to FIG. 3, the ordinate designates a pressure and the abscissa designates a peripheral direction of the heating roller. Assume that the record medium advances to the nip portion from the left side (side of writing the ordinate). Assuming an infinite plane pressing member (not illustrated) having a sufficiently wide width, a maximum nip width is defined by a nip width formed by a pressure distribution (broken line) provided by pressing the infinite plane pressing member to the heating roller 1. Numeral 52 designates a maximum nip outlet point. Numeral 53 designates a maximum nip start point. Next, a plane pressing member providing the maximum nip width is prepared. Assume that the nip width and the width of the plane pressing member are equal. A pressure distribution indicated by a bold line is provided by fixing a condition of a load or the like for providing the maximum nip width, and using the plane pressing member, and moving a position in a direction of transporting the plane pressing member to an upstream side in the direction of transporting the record medium. Numeral 54 designates a nip outlet point after changing the pad position. Numeral 55 designates a pad position change moving amount. In comparison with a slope of a pressure at a nip outlet portion of the pressure distribution (broken line) for providing the maximum nip width, a slope of a pressure at the nip outlet portion of a pressure distribution after changing the pad position (bold line) is large and is proximate to a slope of a pressure at the nip outlet portion of a comparative example (slender line). Such a pressure distribution achieves an effect of increasing an amount of deforming the nip outlet portion of the elastic layer of the heating roller 1 and widening a space between the surface of the record medium and the surface of the heating roller 1 at the nip outlet portion. With regard to the comparative example, a model the same as that of FIG. 3 is used.

Figure 9:
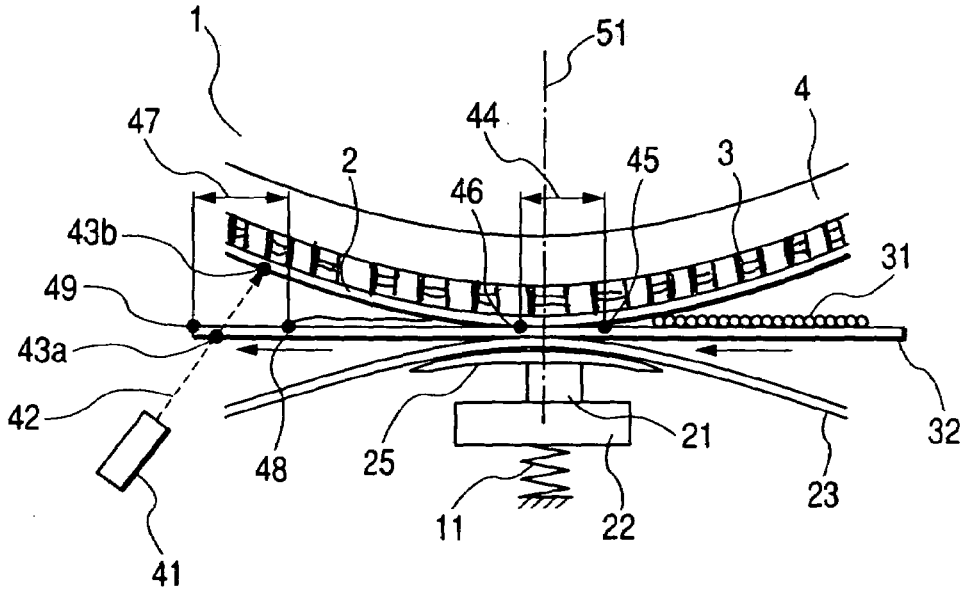
FIG. 9 is a schematic view showing a method of measuring an exfoliating force.

A method of measuring an exfoliating force will be explained in reference to FIG. 9. Numeral 41 designates a laser depth meter. Numeral 42 designates a laser depth measuring line for measuring a depth by the laser depth meter 41. Numeral 43 designates a point of intersecting with the laser depth measuring line 42. Before passing the record medium 32 through the nip portion, an intersection 43*b* is present on the surface of the heating roller 1 and the depth to the intersection 43*b* is measured. After passing the record medium 32 through the nip portion, an intersection 43*a* is present on a back face of the record medium 32 and a depth to the intersection 43*a* is measured. Numeral 44 designates a nip region, numeral 45 designates a nip start point, and numeral 45 designates a nip outlet point. Numeral 47 designates a nonimage region of the record medium. Numeral 48 designates an image region start point. Numeral 49 designates a front end point of the record medium. FIG. 9 shows an exfoliating function evaluating system. Generally, an exfoliating function can be confirmed by passing a sheet which is a record medium through the nip portion and measuring a relative distance between the sheet and the surface of the heating roller 1 at the nip outlet portion. Or, there is also a method of evaluating the exfoliating function by fixing the unfixed toner image and whether the image is made to wrap on the roll. The exfoliating characteristic is evaluated by the above-described method and the pressing position of the flat plate by the pressing pad is moved to an upstream side in a direction of transporting the sheet until achieving the exfoliating function capable of stripping off the sheet by itself. At this occasion, what requires caution is that it is necessary to increase sufficiently a mean pressure (0.010 kgf/mm$^2$ or higher) such that air or steam is not expanded from the sheet or the toner and the unfixed toner 31 is not disturbed by evaporating bubbles. Further, it is necessary to construct a constitution in which a discontinuous pressure distribution, or a local valley in the pressure which is liable to bring about a deficiency in fixing is not produced.

Figure 10:
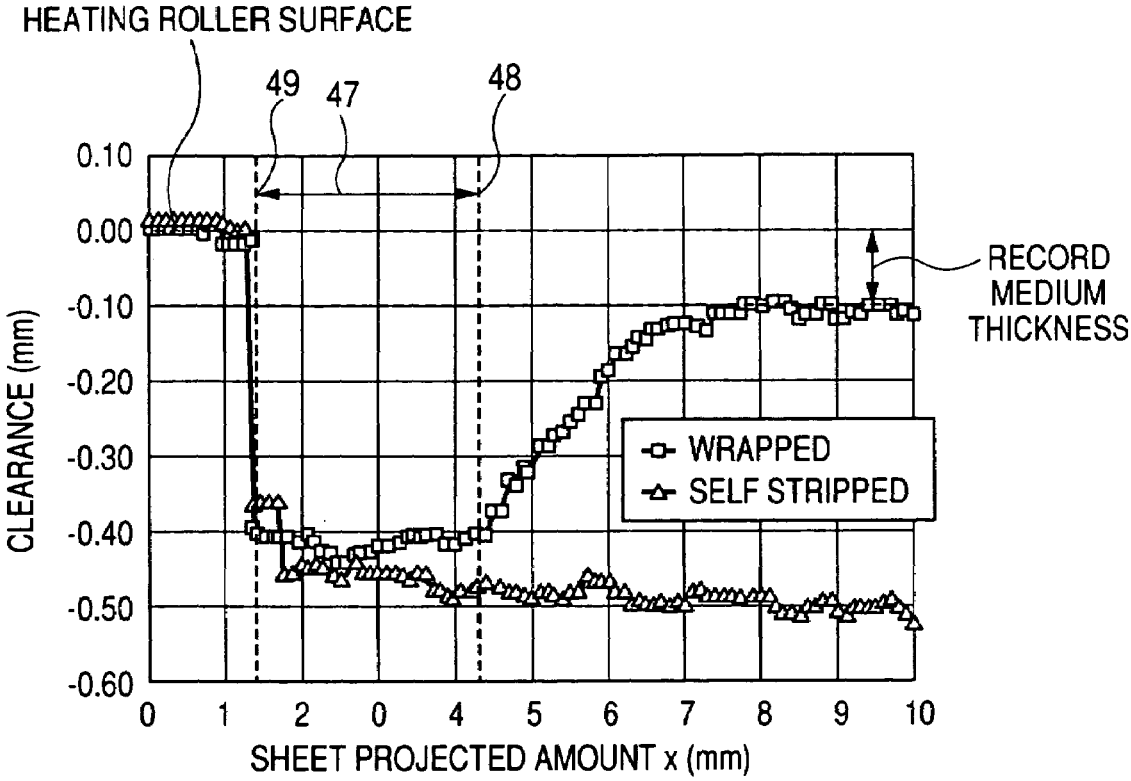
FIG. 10 shows a result of an exfoliating experiment which is carried out by an experimental apparatus of FIG. 9.

FIG. 10 shows an example of a measurement result by the exfoliation measuring system shown in FIG. 9. □ mark designates a measurement result when the record medium 32 is carried by being made to wrap on the heating roller 1. When the depth of the surface of the heating roller 1 is set to 0 mm and at an instance of intersecting the record medium front end point 49 with the depth measuring line, the depth (clearance) is produced by 0.4 mm. Since the back face of the record medium 32 is measured, the actual clearance is constituted by subtracting a thickness (0.1 mm) of the record medium 32 from the measured numerical value. At interval of the record medium nonimage region 47, the record medium 32 is not adhered to the heating roller 1 and therefore, the record medium 32 is carried while maintaining the initial clearance. However, at and after the image region start point 48, the record medium 32 is carried while being made to wrap on the heating roller 1 by an adhering force by the melted toner, the clearance is gradually reduced. It is confirmed that a curve measured at this occasion coincides with a numerical value constituted by adding the record medium thickness to the heating roller outer diameter. When the record medium nonimage region 47 has completely passed therethrough, a clearance by an amount of the thickness of the record medium 32 is measured. A measurement result when the record medium 32 is carried while being stripped off by itself is indicated by Δ mark. By setting a self strippable condition, it can be confirmed that the record medium is carried while the clearance maintains the initial value even at an after the image region start point 48. It seems that by moving the flat plate pressing member to the upstream side in the direction of transporting the record medium 32, there is achieved an effect of promoting the exfoliating characteristic by enlarging the space between the toner adhered to the surface of the record medium 32 and the surface of the heating roller 1 immediately after projecting the front end of the record medium 32 from the outlet portion. That is, this is the curvature exfoliating function utilizing the rigidity of the record medium.

Figure 11:
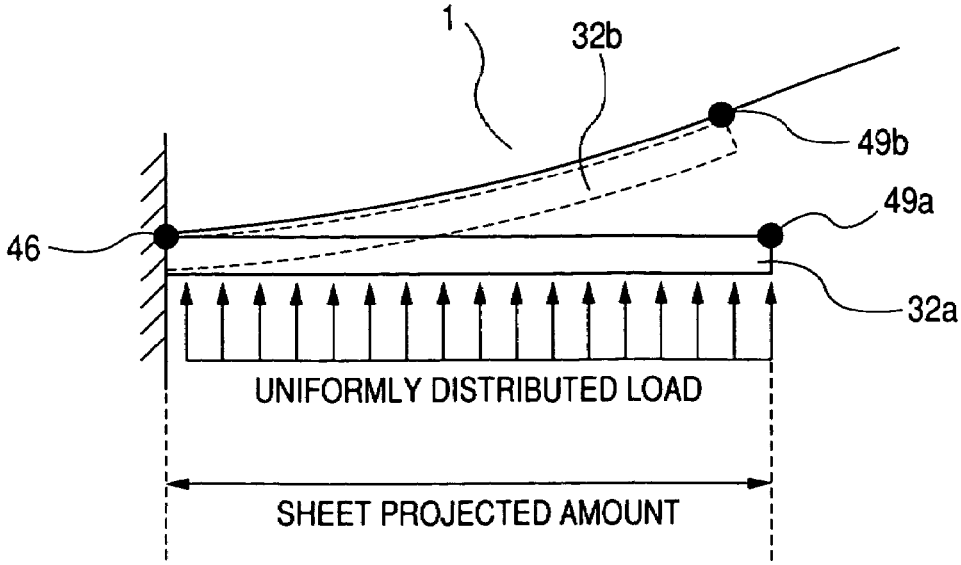
FIG. 11 is a calculation model for calculating an exfoliating force.

FIG. 11 shows a two-dimensional cantilever calculation model for calculating the exfoliating force. A cut sheet is used as the record medium 32. Numeral 46 designates the nip outlet point, and notation 49*a*, 49*b* designate front end points of the record sheet. Notation 32*a* designates a sheet in a state of not being brought into contact with the surface of the heating roller 1 and notation 32*b* designates a sheet in a state of being brought into contact with the heating roller 1. First, a thickness, a width of a sheet are measured to calculate a moment of inertia. A mass (uniformly distributed load) per area of the sheet, the projected length of the sheet in cantilever supporting and an amount of displacing the front end of the sheet in the gravitational force direction to thereby calculate Young's modulus of the sheet. Next, by using the physical property values of the sheet and the measured clearance value, the sheet projected amount is set to 3.5 mm, and the uniformly distributed load necessary for bringing the front end of the sheet into contact with the surface of the heating roller 1 is calculated to constitute the exfoliating force thereby.

FIG. 14 shows an example of the above-described effect. Combinations A through E are set for making variable a heating roller elastic layer thickness, a heating roller elastic layer hardness, a heating roller outer diameter, an endless belt material, an endless belt thickness, a sliding member elasticity coefficient, a sliding member thickness, a sliding member material, a pad width, a pd thickness, a pad elasticity coefficient, a pad holder shape and the like. Under the above-described combination conditions, a white paper sheet is passed through a nip portion heated to 170° C. and an exfoliating force is calculated. In evaluating an exfoliating characteristic, the sheet adhered with a toner of 1.6 mg per square centimeter is passed through the nip portion heated to 170° C. and it is confirmed whether the sheet is made to wrap on the roll. As a result, self stripping can be confirmed by the exfoliating force equal to or large than 0.04 kgf/mm, and it is confirmed that damage (curl problem, paper wrinkle problem) to the sheet can be minimized.

When a hard member is used at a vicinity of an outlet of the nip portion, the exfoliating function can easily be provided. However, by elastically deforming the outlet portion locally by using a small curvature hard member, a speed difference is brought about at inside of the nip portion, as a result, an image shift is produced. Although the problem is resolved by setting a load at the outlet portion, it is difficult to reduce a load applied on the sheet by a local deformation (paper damage). This is because by using the hard member, a curvature of the nip shape is reduced and the load on the sheet is increased by the small curvature. On the other hand, according to the embodiment, the exfoliating function can be promoted without producing the small curvature nip deforming portion and therefore, the damage on the sheet can be restrained to be small. As a further important point, the embodiment can be constituted by the flat plate pressing member having a simple constitution as shown by FIG. 1. According thereto, as a result, a number of steps of forming parts is reduced and cost can be reduced. By using the flat pressing member having the simple constitution, there can be avoided a particular problem brought about by a constitution in which a pressure is excessively low locally or a discontinuous pressure distribution, or a valley of the pressure is produced (air or steam is expanded from sheet or toner and the unfixed toner is disturbed by evaporating bubbles). Because by using the simple flat plate pressing member, it is difficult to pose the problem that a discontinuity, a locally low portion or a valley is produced in the pressure distribution.

Figures 12, 13:
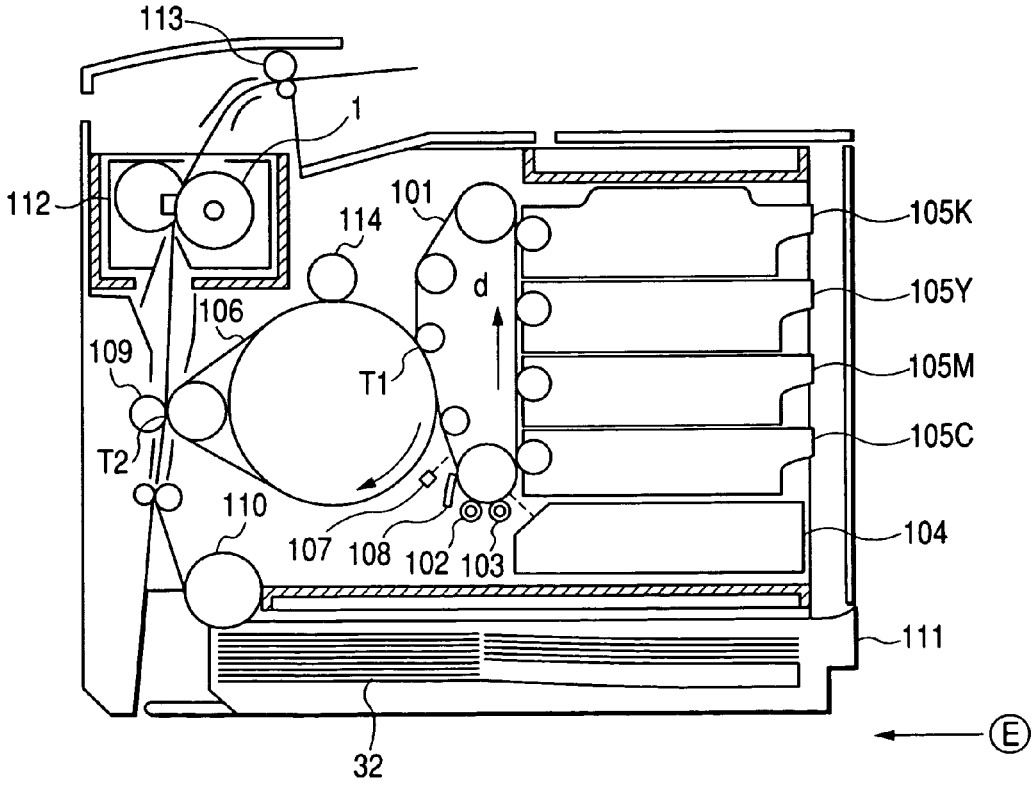
FIG. 12 is a result of an exfoliating experiment which is carried out by the fixing apparatus of FIG. 7.
FIG. 13 is a schematic view showing a total of an image forming apparatus.

FIG. 12 shows other example of the effect. An amount of moving from the maximum nip outlet point is a moving amount for moving from the nip outlet point of the maximum nip width shown in FIG. 8 in the direction of transporting the plane pressing member (minus value indicates upstream side, plus value indicates downstream side). By moving the plane pressing member to the upstream side by 1.2 mm, an exfoliating force of 0.065 kgf/mm can be provided. Under the set condition, a sheet adhered with a toner of 1.6 mg per square centimeter is passed through the nip portion heated to 170° C. and it is evaluated whether the sheet is made to wrap on the roll. As a result, it is confirmed under the above-described setting, the sheet is stripped off by itself. However, when the plane pressing member is moved to the downstream side by 0.7 mm, the exfoliating force is reduced to 0.038 kgf/mm and in evaluating whether the sheet is made to wrap on the roll, it is confirmed that the sheet is not stripped off by itself. Therefore, it is necessary to move the plane pressing member to the nip outlet point of the maximum nip width, or on an upstream side thereof. Further, it is confirmed that under the setting, damage (curl problem, paper wrinkle problem) on the sheet is minimized.

According to the embodiment, the exfoliating function can be promoted without producing a portion of deforming the nip of the small curvature and therefore, damage on the record medium can be restrained to be small. Further, the pressing member can be constituted by a pressing member having a simple constitution and therefore, a number of steps of forming parts is reduced and cost can be reduced. The fixing member of the embodiment is naturally applicable to the fixing apparatus using the endless shape heating member as shown by FIG. 6.

Next, FIG. 13 shows an example of an image forming apparatus mounted with the fixing apparatus explained above. In FIG. 13, numeral 101 designates a photosensitive belt which is supported endlessly movably in an arrow mark d direction. Numeral 102 designates a charging brush, numeral 103 designates a charging roller, the charging blush 102 and the charging roller 103 are provided to be brought into contact with the surface of the photosensitive belt 101 to uniformly charge the surface of the photosensitive belt 101. An exposing apparatus 104 for irradiating light to the surface of the uniformly charged photosensitive belt 101 charges the photosensitive belt 101 by a unit of a dot in accordance with information of image, character by a personal computer, an image scanner or the like to form an electrostatic latent image on the surface of the photosensitive belt 101.

The electrostatic latent image formed on the photosensitive belt 101 is supplied with the toner by any of a developer 105K of a black toner, a developer 105Y of an yellow toner, a developer 105M of a magenta toner, and a developer 105C of a cyan toner to visualize as a toner image and is carried to a first transcribing position T1. At the first transcribing position T1, the toner image on the photosensitive belt 101 is transcribed to a surface of an intermediate transcriber 106 by a potential difference between the photosensitive belt 101 and the intermediate transcriber 106.

The potential of the surface of the photosensitive belt 101 passing through the first transcribing position T1 is reduced to a constant amount or lower by irradiating light from a remaining image remover 107 to erase the electrostatic latent image, successively, a toner remaining on the photosensitive belt 101 without being transcribed at the first transcribing position T1 is removed by a cleaning apparatus 108 to bring about a state of being able to form a next image.

By repeating the above-described steps by a necessary number of times by the respective developers 105K, 105Y, 105M, 105C, the toner image compatible with information of image, character is formed on the surface of the intermediate transcriber 106.

Thereafter, the toner image transcribed onto the intermediate transcriber 106 is transcribed to the record medium 32 supplied from a cassette 111 by a record medium supplying apparatus 110 by a transcriber 109 at a second transcribing position T2. The record medium 32 transcribed with the toner image is exfoliated from the intermediate transcriber 106, carried to a fixing apparatus 112 to fix the toner image onto the record medium 32 and is discharged to a record medium discharging apparatus 113. Further, numeral 114 designates a cleaning apparatus for cleaning the surface of the intermediate transcriber 106.

When the fixing apparatus of the invention is applied to the image forming apparatus, the exfoliating function of the fixing apparatus is promoted and therefore, high reliability can be achieved. Further, small-sized formation, low cost formation, energy saving formation of the fixing apparatus can be achieved and therefore, small-sized formation, low cost formation, energy saving formation of the image forming apparatus can be achieved. Further, by promoting the exfoliating function, high speed formation of the image forming apparatus can be achieved, a large load is not applied on the sheet and therefore, a disturbance of an image in fixing is reduced, which amounts to high image quality formation.

According to the above-embodiments, there can be provided the fixing apparatus and the image forming apparatus maintaining a self stripping function, capable of promoting an image quality, reducing a load applied on the sheet and suitable for designing a robust nip width having a low sensitivity relative to a load value.

What is claimed is:

1. A fixing apparatus for transporting a record medium while being adhered with an unfixed toner image to pass a nip portion formed by an endless shape member included in a pressing member and a heating member including an elastic layer and a heat source, and for fixing an unfixed toner image on a record medium, wherein the pressing member comprises a pressing member in which a width of the pressing member in a direction of transporting the record medium becomes a width the same as a nip width formed when the heating member is pressed by using an infinite flat plate to be brought into contact therewith, or smaller than the nip width.

2. The fixing apparatus according to claim 1, wherein the heating member comprises a rotatable heating roller comprising the elastic layer and a heat source at an inside thereof.

3. The fixing apparatus according to claim 1, wherein the heating member comprises the elastic layer, the heat source, an endless shape heating member, and a plurality of rotatable rollers for holding the endless shape heating member.

4. An image forming apparatus comprising:

a plurality of developing members for forming different colors of a toner image;

a sensitizing member for adhering the toner image of the developing members onto a surface thereof;

an intermediate transcribing member for transcribing the toner image of the sensitizing member;

a transcribing member for transcribing the toner image of the intermediate transcribing member onto a record medium; and a fixing apparatus for transporting the record medium while being adhered with an unfixed toner image to pass a nip portion formed by an endless shape member included in a pressing member and a heating member including an elastic layer and a heat source, and for fixing an unfixed toner image on the record medium, wherein the pressing member comprises a pressing member in which a width of the pressing member in a direction of transporting the record medium becomes a width the same as a nip width formed when the heating member is pressed by using an infinite flat plate to be brought into contact therewith, or smaller than the nip width.

5. A fixing apparatus for transporting a record medium while being adhered with an unfixed toner image to pass a nip portion formed by an endless shape member included in a pressing member and a heating member including an elastic layer and a heat source, and for fixing an unfixed toner image on a record medium, wherein an end face of the pressing member is arranged on an upstream side in a direction of transporting the record medium of a point at which a surface of the record medium and a surface of the heating member are separated at a nip portion formed when the heating member is pressed by using an infinite flat plate to be brought into contact therewith.

6. The fixing apparatus according to claim 5, wherein the heating member comprises a rotatable heating roller comprising the elastic layer and the heat source at an inside thereof.

7. The fixing apparatus according to claim 5, wherein the heating member comprises the elastic layer, the heat source, an endless shape heating member, and a plurality of rotatable rollers for holding the endless shape heating member.

8. An image forming apparatus comprising:

a plurality of developing members for forming different colors of a toner image;

a sensitizing member for adhering the toner image of the developing members onto a surface thereof an intermediate transcribing member for transcribing the toner image of the sensitizing member;

a transcribing member for transcribing the toner image of the intermediate transcribing member onto a record medium; and a fixing apparatus for transporting the record medium while being adhered with an unfixed toner image to pass a nip portion formed by an endless shape member included in a pressing member and a heating member including an elastic layer and a heat source, and for fixing an unfixed toner image on the record medium, wherein an end face of the pressing member is arranged on an upstream side in a direction of transporting the record medium of a point at which a surface of the record medium and a surface of the heating member are separated at a nip portion formed when the heating member is pressed by using an infinite flat plate to be brought into contact therewith.

9. A fixing apparatus for transporting a record medium while being adhered with an unfixed toner image to pass a nip portion formed by an endless shape member included in a pressing member and a heating member including an elastic layer and a heat source, and for fixing an unfixed toner image on the record medium, wherein an exfoliating force at a point apart from a point of separating a surface of the record medium and a surface of the heating member at the nip portion by 3.5 mm along the surface of the record medium is set to be equal to or larger than 0.04 kgf/mm.

10. The fixing apparatus according to claim 9, wherein the heating member comprises a rotatable heating roller comprising the elastic layer and the heat source at an inside thereof.

11. The fixing apparatus according to claim 9, wherein the heating member comprises the elastic layer, the heat source, an endless shape heating member, and a plurality of rotatable rollers for holding the endless shape heating member.

12. An apparatus including the fixing apparatus according to claim 9, wherein fixing on the record medium is executed by using the fixing apparatus.

* * * * *